252-103 AU 115 EX
4/26/88 OR 4,740,327

United States Patent [19]
Julemont et al.

[11] Patent Number: 4,740,327
[45] Date of Patent: Apr. 26, 1988

[54] AUTOMATIC DISHWASHER DETERGENT COMPOSITIONS WITH CHLORINE BLEACH HAVING THIXOTROPIC PROPERTIES

[75] Inventors: Michael Julemont, Heusy; Maurice Marchal, Angleur, both of Belgium

[73] Assignee: Colgate-Palmolive Company, N.Y.

[21] Appl. No.: 926,819

[22] Filed: Oct. 31, 1986

Related U.S. Application Data

[63] Continuation of Ser. No. 818,069, Jan. 13, 1986, abandoned, which is a continuation of Ser. No. 725,519, Apr. 22, 1985, abandoned, which is a continuation of Ser. No. 497,615, May 24, 1983, abandoned, which is a continuation-in-part of Ser. No. 455,983, Jan. 10, 1983, abandoned, which is a continuation-in-part of Ser. No. 339,915, Jan. 18, 1982, abandoned.

[51] Int. Cl.[4] ..... C11D 1/24
[52] U.S. Cl. ..... 252/103; 252/99; 252/135; 252/140; 252/156; 252/160; 252/173; 252/174.14; 252/174.16; 252/174.25; 252/539; 252/558
[58] Field of Search ..... 252/99, 103, 135, 140, 252/156, 160, 173, 174.14, 174.16, 174.25, 539, 558

[56] References Cited

U.S. PATENT DOCUMENTS

| | | | |
|---|---|---|---|
| 3,248,330 | 4/1966 | Feierstein et al. | 252/99 |
| 3,314,891 | 4/1967 | Schmolka et al. | 252/135 |
| 3,630,928 | 12/1971 | Fuchs | 252/99 |
| 4,005,027 | 1/1977 | Hartman | 252/173 |
| 4,071,463 | 1/1978 | Steinhauer | 252/99 |
| 4,115,308 | 9/1978 | Guerry | 252/99 |
| 4,116,849 | 9/1978 | Leikhim | 252/135 |
| 4,147,650 | 4/1979 | Sabatelli et al. | 252/156 |
| 4,155,871 | 5/1979 | Donaldson | 252/156 |
| 4,271,030 | 6/1981 | Brierley et al. | 252/98 |
| 4,431,559 | 2/1984 | Ulrich | 252/99 |
| 4,511,487 | 4/1985 | Prühs et al. | 252/99 |
| 4,512,908 | 4/1985 | Heile | 252/99 |

*Primary Examiner*—Robert Wax
*Attorney, Agent, or Firm*—H. S. Sylvester; N. Blumenkopf; M. M. Grill

[57] ABSTRACT

An aqueous highly alkaline thixotropic automatic dishwasher composition containing alkalimetal tripolyphosphate, sodium silicate, chlorine bleach stable organic detergent active surfactant material, chlorine bleach compound, preferably sodium hypochlorite, thixotropic thickener, preferably montmorrilonite or attapulgite clay, and preferably chlorine bleach stable foam depressant such as a higher alkyl acid phosphate ester, caustic soda and soda ash.

38 Claims, No Drawings

AUTOMATIC DISHWASHER DETERGENT COMPOSITIONS WITH CHLORINE BLEACH HAVING THIXOTROPIC PROPERTIES

This application is a continuation of application Ser. No. 818,069, filed 1-13-86 which is a continuation of application Ser. No. 725,519, filed 4-22-85, which was a continuation of application Ser. No. 497,615, filed 5-24-84, which was a continuation-in-part of application Ser. No. 455,983, filed 1-10-83, which was a continuation-in-part of application Ser. No. 339,915, filed 1-18-82, the last 5 abandoned.

The invention relates to automatic dishwashing detergent compositions having thixothropic properties, improved chemical and physical stability, and which are readily dispersible in the washing medium to provide effective cleaning of dishware, glassware, china and the like.

Commercially available household-machine dishwasher detergent provided in powder form has several disadvantages, e.g., nonuniform composition; costly operations necessary in their manufacture; tendency to cake in storage at high humidities, resulting in the formation of lumps difficult to disperse; dustiness, a source of particular irritation to users who suffer allergies; and tendency to cake in the dishwasher machine dispenser. Liquid forms of such compositions, moreover, generally cannot be used in automatic dishwashers due to high foam levels, unacceptably low viscosities and exceedingly high alkalinity.

Recent research and development activity has focussed on the gel or "thixotropic" form of such compositions, e.g., scouring cleansers and automatic-dishwasher products characterized as thixotropic pastes. Dishwasher products so provided are primarily objectionable in that they are insufficiently viscous to remain "anchored" in the dispenser cup of the dishwasher, and moreover yield spotty residues on dishware, glassware, china and the like. Ideally, thixotropic cleansing compositions should be highly viscous in a quiescent state, Bingham plastic in nature, and have relatively high yield values. When subjected to shear stresses, however, such as being shaken in a container or squeezed through an orifice, they should quickly fluidize and, upon cessation of the applied shear stress, quickly revert to the high viscosity/Bingham plastic state. Stability is likewise of primary importance, i.e., there should be no significant evidence of phase separation or leaking after long standing.

The provision of automatic-dishwasher compositions in gel form having the aforedescribed properties has thus far proved problematical, particularly as regards compositions for use in home dishwasher machines. For effective use, it is generally recommended that the automatic dishwashing detergent, hereinafter also designated ADD, contain (1) sodium tripolyphosphate (NaTPP) to soften or tie up hard-water minerals and to emulsify and/or peptize soil; (2) sodium silicate to supply the alkalinity necessary for effective detergency and to provide protection for fine china glaze and pattern; (3) sodium carbonate, generally considered to be optional, to enhance alkalinity; (4) a chlorine-releasing agent to aid in the elimination of soil specks which lead to water spotting; and (5) defoamer/surfactant to reduce foam, thereby enhancing machine efficiency and supply requisite detergency. See, for example, SDA Detergents in Depth, "Formulations Aspects of Machine Dishwasing," Thomas Oberle (1974). Cleansers approximating the aforedescribed composition are mostly liquids or powders. Combining such ingredients in a gel form effective for home-machine use has proved difficult. Generally, such compositions omit hypochlorite bleach, since it tends to react with other chemically active ingredients, particularly surfactant, thereby degrading the suspending or thixotropic agent and impairing its effectiveness. Thus, U.S. Pat. No. 4,115,308 discloses thixotropic automatic dishwasher pastes containing a suspending agent, e.g., CMC, synthetic clays or the like; inorganic salts including silicates, phosphates, polyphosphates, etc.; a small amount of surfactant and a suds depressor. Bleach is not disclosed. U.S. Pat. No. 4,147,650 is somewhat similar, optionally including Cl-bleach but no organic surfactant or foam depressant. The product is described, morever, as a detergent slurry with no apparent thixotropic properties.

U.S. Pat. No. 3,985,668 describes abrasive scouring, cleaners of gel-like consistency containing (1) suspending agent, preferably the smectite and attapulgite types of clay; (2) abrasive, e.g., silica sand or perlite; and (3) filler comprising light density powdered polymers, expanded perlite and the like, which has a buoyancy and thus stabilizing effect on the composition in addition to serving as a bulking agent, thereby replacing water otherwise available for undesired supernatant layer formation due to leaking and phase destabilization. The foregoing are the essential ingredients. Optionals include hypochlorite bleach, bleach stable surfactant and buffer, e.g., silicates, carbonates, monophosphates, etc. Builder such as NaTPP can be included as a further optional to supply or supplement building function not provided by the buffer, the amount of such builder not exceeding 5% of the total composition, according to the patent. Maintenance of the desired >pH10 levels is enabled by the buffer/builder components. High pH is said to minimize decomposition of chlorine bleach and undesired interaction between surfactant and bleach. When present, NaTPP is limited to 5%, as stated. Foam killer is not disclosed.

Thus, a primary object of the invention is to provide a detergent composition having thixotropic properties, beneficially adapted for use in an automatic dishwasher, and not subject to one or more of the above-described deficiencies.

A further object of the invention is to provide such a composition having good physical stability with no significant phase separation being evident after prolonged periods of standing.

Another object of the invention is to provide such a composition wherein problems associated with undesired interaction of chemically active ingredients are eliminated or at least susstantially mitigated.

Yet another object of the invention is to provide such a composition having the aforementioned stability under the highly alkaline conditions necessary for effective detergent performance.

Still another object of the invention is to provide such a composition having improved rheological properties exhibiting higher viscosities at low shear rates and lower viscosities at high shear rates—thus advantageously adapted for use in the dispenser cup of automatic dishwashing machines.

Yet a further object of the invention is to provide such a composition having low foam characteristics, improved detergency and being readily dispersible in the washing machine.

Other objects and advantages of the invention will become apparent herein after.

The foregoing objects are attained in accordance with the invention which in its broader aspects provides a normally gel-like aqueous automatic dishwasher-detergent composition having thixotropic properties comprising, approximately by weight:

(a) 8 to 35% alkali metal tripolyphosphate;
(b) 2.5 to 20% sodium silicate;
(c) 0 to 9% alkali metal carbonate;
(d) 0.1 to 5% chlorine bleach stable, water-dispersible organic detergent active material;
(e) 0 to 5% chlorine bleach stable foam depressant;
(f) chlorine bleach compound in an amount to provide about 0.2 to 4% of available chlorine; and
(g) thixotropic thickener in an amount sufficient to provide the composition with thixotropy index of about 2.5 to 10.

ADD compositions so formulated are low-foaming; stable, both chemically and physically; are readily soluble in the washing medium and most effective at pH values best conductive to improved cleaning performance, viz, pH 10.5–13.5. The compositions are normally of gel consistency, i.e., a highly viscous, opaque jellylike material having Bingham plastic character and thus relatively high yield values. Accordingly a definite shear force is necessary to initiate or increase flow, such as would obtain within the agitated dispenser cup of an energized automatic dishwasher. Under such conditions, the composition is quickly fluidized and easily dispersed. When the shear force is discontinued, the fluid composition quickly reverts to a high viscosity, Bingham plastic state closely approximating its prior consistency.

Generally, ADD effectiveness is directly related to (a) available chlorine levels; (b) alkalinity; (c) solubility in washing medium; and (d) foam inhibition. It is preferred herein that the pH of the ADD composition be at least about 9.5, more preferably from about 10.5–13.5 and most preferably at least about 11.5. At relatively lower pH values, the ADD product is too viscous, i.e., solid-like, and thus not readily fluidized under the shear-force levels created within the dispenser cup under normal machine-operating conditions. In essence, the composition loses much, if not all, of its thixotropic character. Addition of NaOH is thus often needed to increase the pH to within the above ranges, and flowability properties. The presence of carbonate is also often needed herein, since it acts as a buffer enabling maintenance of the desired pH level. Excess carbonate is to be avoided, however since it may cause the formation of needle-like crystals of carbonate, thereby impairing the stability, thixotropy and/or detergency of the ADD product. Caustic soda (NaOH) serves the further function of neutralizing the phosphoric or phosphonic acid ester foam depressant when present. About 0.5 to 3 wt.% of NaOH and about 2 to 9 wt. % of sodium carbonate in the composition are typical although it should be noted that sufficient alkalinity may be provided by the NaTPP and sodium silicate.

The NaTPP employed in the composition in a range of about 8 to 35 wt. %, preferably about 20 to 30 wt. %, should preferably be free of heavy metal which tends to decompose or inactivate the preferred sodium hypochlorite and other chlorine bleach compounds. To improve and expedite hydration and solubilization of the NaTPP, and to avoid undue thickening of the composition, the NaTPP should not be completely anhydrous and is preferably humidified or hydrated to contain up to about 15% water corresponding to an average degree of hydration of about 5 (pentahydrate). Actually, humidification to an average of about 0.3 to 1% water is highly effective, serving to form seeds of the stable hexahydrate which expedites hydration and solubilization of the remaining NaTPP particles.

Foam inhibition is important to increase dishwasher machine efficiency and minimize destabilizing effects which might occur due to the presence of excess foam within the washer during use. Foam may be sufficiently reduced by suitable selection of the type and/or amount of detergent active material, the main foam-producing component. The degree of foam is also somewhat dependent on the hardness of the wash water in the machine whereby suitable adjustment of the proportions of NaTPP which has a water-softening effect may aid in providing the desired degree of foam inhibition. However, it is generally preferred to include a chlorine bleach stable foam depressant or inhibitor. Particularly effective are the alkyl phosphonic acid esters of the formula

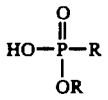

available for example from BASF-Wyandotte (PCUK-PAE), and especially the alkyl acid phosphate esters of the formula

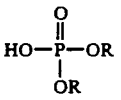

available for example from Hooker (SAP) and Knapsack (LPKn-158), one or both R groups in each type of ester being independently $C_{12-20}$ alkyl. Mixtures of the two types, or any other chlorine bleach stable types, or mixtures of mono- and di-esters of the same type, may be employed. Especially preferred is a mixture of mono- and di-$C_{16-18}$ alkyl acid phosphate esters such as monostearyl/distearyl acid phosphates 1.2/1 (Knapsack). When employed, proportions of 0.1 to 5 wt. %, preferably about 0.1 to 0.5 wt. %, of foam depressant in the composition is typical, the weight ratio of detergent active component (d) to foam depressant (e) generally ranging from about 10:1 to 1:1 and preferably about 4:1 to 1:1. Other defoamers include, e.g. the known silicones, etc.

Although any chlorine bleach compound may be employed in he compositions of this invention, such as dichloro-isocyanurate, dichloro-dimethyl hydantoin, chlorinated TSF and the like, alkali metal, e.g. potassium, lithium, megnesium and especially sodium, hypochlorite is preferred. The composition should contain (i.e. sufficient chlorine bleach compound to provide) about 0.2 to 4 wt. % of available chlorine, as determined for example by acidification of 100 parts of the composition with excess hydrochloric acid. A solution containing about 0.2 to 4 wt. % of sodium hypochlorite contains or provides roughly the same percent of available chlorine. About 0.8 to 1.6 wt. % of available chlorine is especially preferred.

The sodium silicate, which provides alkalinity and protection of hard surfaces such as fine china glaze and pattern, is employed in an amount ranging from about 2.5 to 20 wt. %, preferably about 5 to 15 wt. %, in the composition. The sodium silicate is generally added in the form of an aqueous solution, preferably having an $Na_2O:SiO_2$ ratio of about 1:2.2 to 1:2.8. At this point it should be mentioned that most of the other compenents of this composition, especially NaOH, sodium hypochlorite, foam depressant and thixotropic thickener, are also often added in the form of a preliminarily prepared aqueous dispersion or solution.

Detergent active material useful herein must be stable in the presence of chlorine bleach, especially hypochlorite bleach, and preferably comprise those of the organic anionic, amine oxide, phosphine oxide, sulfoxide and betaine water-dispersible surfactant types, the former being most preferred. They are used in amounts ranging from about 0.1 to 5% and preferably about 0.3 To 0.8%. Particularly preferred surfactants herein are the linear or branched alkali metal mono-and/or di-$C_{8-14}$ alkyl diphenyl oxide mono- and/or disulfonates, commercially available for example as DOWFAX 3B-2 and DOWFAX 2A-1. In general, the paraffin sulfonates tend to impair, if not destroy thixotropy, having been found to unduly increase viscosity causing severe shearing force problems. In addition, the surfactant should be compatible with the other ingredients of the composition. Other suitable surfactants include the primary alkylsulphates, alkylsulphonates, alkylarylsulponates and sec.-alkylsulphates. Examples are sodium $C_{10}$–$C_{18}$ alkylsulphates such as sodium dodecylsulphate and sodium tallow alcholsulphate; sodium $C_{10}$–$C_{18}$ alkanesulphonates such as sodium hexadecyl-1-sulphonate; and sodium $C_{12}$–$C_{18}$ alkylbenzenesulphonates such as sodium dodecylbenzenesulphonate. The corresponding potassium salts may also be employed.

As other suitable surfactants or detergents, the amine oxide surfactants are typically of the structure $R_2R^1NO$, in which each R is a lower alkyl group, for instance methyl, and $R^1$ is a long chain alkyl group having from 8 to 22 carbon atoms, for instance a lauryl, myristyl, palmityl or cetyl group. Instead of an amine oxide, a corresponding surfactant phosphine oxide $R_2R^1PO$ or sulphoxide $RR^1SO$ can be employed. Betaine surfactants are typically of the structure $R_2R^1N{+}R''COO-$, in which each R is a lower alkylene group having from 1 to 5 carbon atoms. Specific examples of these surfactants are lauryl-dimethylamine oxide, myristyldimethylamine oxide, cocodimethylamine oxide, hardened tallow dimethyl amine oxide, the corresponding phosphine oxides and sulphoxides, and the corresponding betaines including dodecyldimethylammonium acetate, tetradecyl-diethylammonium pentanoate, hexadecyldimethylammonium hexanoate and the like. For biodegradability, the alkyls in these surfactants should be linear, and are preferred.

Surfactants of the foregoing type, all well known in the art, are described, for example, in U.S. Pat. Nos. 3,985,668 and 4,271,030.

Thixotropic thickeners, i.e. thickeners or suspending agents which provide an aqueous medium with thixotropic properties, are known in the art and may be organic or inorganic water soluble, water-dispersible or colloid-forming, and monomeric or polymeric, and should of course be stable in these compositions, e.g. stable to high alkalinity and chlorine bleach compounds such as sodium hypochlorite. Those specially preferred generally comprise the inorganic, colloid-forming clays of smectite and/or attapulgite tupes. These materials are generally used in amounts of 1.5 to 10, preferably about 2 to 5 wt. % but in any event in an amount sufficient to confer the desired thixotropic properties and Bingham plastic character.

Smectite clays include montmorillonite (bentonite), hectorite, saponite, and the like. Materials of this type are available under trade names such as Thixogel No. 1 and Gelwhite GP from Georgia Kaolin Company (both being montmorillonites). Attapulgite clays include the materials commercially available under the trade name Attagel, i.e., Attagel 40, Attagel 50 and Attagel 150 from Engelhard Minerals and Chemicals Corporation. Mixtures of smectite and attapulgite types in weight ratios of 4:1 to 1:5 are also useful herein. Thickening or suspending agents of the foregoing types are well known in the art, being described, for example, in the referenced U.S. Pat. No. 3,985,668. Abrasives or polishing agents should be avoided.

The amount of water contained in these compositions should of course be neither so high as to produce unduly low viscosity and fluidity, nor so low as to produce unduly high viscosity and low flowability, thixotropic properties in either case being diminished or destroyed. Such amount is readily determined by routine experimentation in any particular instance, generally ranging from about 45 to 75 wt. %, preferably about 55 to 65 wt. %. The water should also be preferably deionized or softened.

The ADD product of this invention exhibits improved rheological properties as evaluated by testing product viscosity as a function of shear rate. Investigation confirms the compositions to exhibit higher viscosity at a low shear rate and lower viscosity at a high shear rate the data indicating efficient fluidization and gellation well within the shear rates extant within the dishwasher machine. In practical terms, this means improved pouring and processing characteristics as well as less leaking in the machine dispenser-cup, compared to current liquid or gel ADD products. For applied shear rates corresponding to 3 to 30 rpm, viscosities (Brookfield) correspondingly range from about 15,000–30,000 cps. to about 3000–5000 cps., as measured at room temperature by means of an LVT Brookfield viscosimeter after 3 minutes using a #4 spindle. A shear rate of 7.4 $sec^{-1}$ corresponds to a spindle rpm of about 3. An approximate ten-fold increase in shear rate produces a six-to seven-fold reduction in viscosity. With current ADD gels, the corresponding reduction in viscosity is only about two-fold. Moreover, with such compositions, the initial viscosity taken at about 3 rpm is only about 2500–2700 cps. The instant compositions thus exhibit threshold fluidizations at lower shear rates and of significantly greater extent in terms of incremental increases in shear rate vs. incremental decrease in viscosity. This property of the instant ADD products is summarized in terms of a thixotropic index (TI) which measures the ratio of (a) apparent viscosity at 3 rpm to (b) apparent viscosity at 30 rpm. The present compositions have a TI of from 2.5 to 10 and preferably 6 to 8. Each of the ADD compositions tested exhibited substantial and quick return to prior quiescent state consistency when the shear force is discontinued.

According to one preferred method of making these compositions, one should dissolve or disperse first all the inorganic salts, i.e., carbonate (when employed), silicate and tripolyphosphate, in the aqueous medium.

Thickening agent is added last. The foam depressor (when employed) is preliminarily provided as an aqueous dispersion, as is the thickening agent. The foam depressant dispersion, caustic soda (when employed) and inorganic salts are first mixed at elevated temperatures in aqueous solution (deionized water) and thereafter cooled, using agitation throughout. Bleach, surfactant and thickener dispersion at room temperature are thereafter added to the cooled (25°–35° C.) solution. Excluding the chlorine bleach compound, total salt concentration (NaTPP, sodium silicate and carbonate) is generally about 20 to 50 wt. %, preferably about 30 to 40 wt. %, in the composition.

Other conventional ingredients may be included in these compositions in small amounts generally less than about 3 wt. % such as perfume, hydrotropic agents such as the sodium benzene, toluene, xylene and cumene sulfonates, preservatives, dyestuffs and pigments and the like, all of course being stable to chlorine bleach compounds and high alkalinity (properties of all the components). Especially preferred for coloring are the chlorinated phthalocyanines and polysulfides of aluminosilicate which provide, respectively, pleasing green and blue tints. $TiO_2$ may be employed for whitening or neutralizing off-shades.

The liquid ADD compositions of this invention are readily employed in known manner for washing dishes, other kitchen utensils and the like in an automatic dish washer, provided with a suitable detergent dispenser, in an aqueous wash bath containing an effective amount of the composition.

The following examples are only illustrative of preferred embodiments and are not to be considered as limiting the invention. All amounts and proportions referred to herein are by weight of the composition unless otherwise indicated.

EXAMPLE 1

A preliminary dispersion of foam suppressor, comprising a 2:1 mixture of mono- and di-($C_{16}$–$C_{18}$) alkyl esters of phosphoric acid[1], 0.16 g, in 6 g. water is prepared by mixing at 60° C. for 30 minutes using a disk impeller. This dispersion is designated Part I.

A preliminary dispersion of GELWHITE GP (hydration) thickener, 3 g. in 17 g. water, is prepared by mixing at 70° C. for 10 minutes using a Z-Blade mixer. This dispersion is designated Part 2.

The following ingredients are mixed in a Giusti mixer at 50°–60° C.:

| | % | AI %[2] |
|---|---|---|
| Deionized water | 16.9 | |
| Part I | 6.16 | 0.16 |
| Caustic soda sol'n, 40% NaOH | 2.40 | 1.2 |
| Sodium carbonate | 7.00 | 7.0 |
| Sodium silicate, 47.5% solution[3] | 13.74 | 6.5 |
| Sodium TPP (substantially anhydrous)[4] | 12.00 | 11.54 |
| Sodium TPP (hexahydrate) | 12.00 | 9.36 |

The mixture is cooled to 25°–30° C., maintaining agitation throughout, and the following ingredients at room temperature are added thereto:

| | % | AI %[2] |
|---|---|---|
| Sodium hypochlorite soln-13% available chlorine | 7.615 | 1.0 |
| Part 2 (dispersed with highspeed turbine) | 20.00 | 3.0 |

-continued

| | % | AI %[2] |
|---|---|---|
| Dowfax 3B-2[5] | 0.80 | 0.36 |

[1]Knapsack LPKn158
[2]Active Ingredient
[3]$Na_2O:SiO_2$— 1:2.4
[4]i.e., 0–5%, especially 3%, moisture
[5]45% Na monodecyl/didecyl diphenyl oxide disulfonates, aqueous solution An opaque composition (about 40% AI) having a gel-like consistency is obtained. The composition is determined to have a TI of about 7, according to the procedure hereinbefore described, based upon apparent viscosity values of 28,000 cps. and 4,000 cps. at 3 rpm and 30 rpm respectively. When tested in an automatic dishwasher apparatus provided with a suitable dispenser cup, the above composition provides excellent cleaning performance and is easily and quickly dispensed. The composition is observed to be satisfactorily nonfoaming. Little or no phase separation is observed after prolonged standing in a closed container. The pH of the composition, measured as a 1% solution in water, is 11.6. When conducting the shear-test evaluations, it is observed that the composition quickly reverts to its prior quiescent state consistency, suggesting no appreciable loss of yield value when tested within the limits hereinbefore described, ie.e., within shear-force limiting values at least approximately those extant within an energized automatic dishwasher. No discernible difference obtains when dispensing the ADD product by squeeze tube rather than dispenser cup.

EXAMPLE 2

Example 1, illustrating a combined polyphosphate carbonate silicate concentration of about 37% is repeated, but varying the total concentration of such salts within the limits previously given. Best results obtain at a combined-salt concentration of at least 30% and particularly when the sodium tripolyphosphate concentration is at least about 20%. Higher silicate concentrations, desirable to protect china glaze and patterns, also impart higher alkalinity which can be compensated for by appropriately reducing the caustic soda concentration and/or adjusting the sodium carbonate (buffer) concentration. The composition appears to be most sensitive, resultwise, to variations in the NaTPP concentration (the higher concentration range is more effective) as well as its degree of hydration. Variations in surfactant concentration generally require corresponding and direct variations in foam-suppressor concentration to achieve the desired low-foam levels.

Decrease of the composition pH of Example 1 below about 10.5 is accompanied by significant decrease in composition effectiveness, as well as corresponding decrease of flowability.

EXAMPLE 3

Similar results are obtained when the procedure of Example 1 is repeated, but replacing corresponding ingredients with alkyl sulfate surfactant, e.g., sodium coconut alkyl sulfate, attapulgite clay, e.g., Attagel 50; and 2:1 mixture of montmorillonite and Attagel 50. The addition of small amounts, e.g., 0.002–0.05% of chlorinated phthalocyanine and aluminosilicate dyes respectively to the Example 1 composition (included with the preliminary thickener dispersion or post-added to the cooled solution) produces pleasantly colored green and blue compositions respectively.

EXAMPLE 4

In this example, the ingredients are added with agitation to the mixing vessel in sequence in order as listed with final homogenation:

| | Parts (wt.) |
|---|---|
| Deionized water | 39.436 |
| 2% Green color solution | 0.173 |
| Attagel 50 clay thickener[1] | 3.375 |
| Titanium dioxide - Anatase | 0.375 |
| $Na_5TPP$ −0.5% moisture (½ total) | 11.558 |
| Knapsack LPKn158[2] | 0.160 |
| 13% Sodium hypochlorite solution[3] | 9.230 |
| | 3.000 |
| 47.5% Sodium silicate solution[4] | 17.895 |
| 49% Sodium hydroxide solution | 2.600 |
| $Na_5TPP$ −0.5% moisture | 11.558 |
| Dowfax 3B-2[5] | 0.800 |
| Standards | |
| Total Moisture | 59.5% |
| Available chlorine | 1.2% +/− 0.1% |
| Silicates | 8.5% |
| pH | 12.8 −/− 0.3 |
| Specific gravity | 13.5 Min. |
| Viscosity (Brookfield RVF, #5 spindle, 20 RPM for 20 rev. @ 25° C. | 9,250 −/− 3,250 cps. |

[1]Attapalgite
[2]Foam depressant
[3]13% Available chlorine, approx.
[4]$Na_2O:SiO_2$— 1:2.4
[5]Detergent active surfactant This invention has been disclosed with respect to preferred embodiments, and it will be understood that modifications and variations thereof obvious to those skilled in the art are to be included within the spirit and purview of this application and the scope of the appended claims.

What is claimed is:

1. An aqueous thixotropic automatic dishwasher composition having a pH of about 10.5 to 13.5 and comprising approximately by weight:

(a) 8 to 35% sodium tripolyphosphate;
(b) 2.5 to 20% sodium silicate;
(c) 0 to 9% sodium carbonate;
(d) 0.1 to 5% chlorine bleach stable, water-dispersible organic detergent active material selected from the class consisting of branched alkali metal mono- and di-$C_{8-14}$ alkyl diphenyl oxide mono- and disulfonates and linear alkali metal mono- and di-$C_{8-14}$ alkyl diphenyl oxide mono- and disulfonates;
(e) 0.1 to 5% chlorine bleach stable foam depressant selected from the class consisting of alkyl phosphonic acid esters and alkyl acid phosphate esters;
(f) sodium hypochlorite in an amount to provide about 0.2 to 4% of available chlorine;
(g) a thixotropic thickener in an amount sufficient to provide the composition with a thixotropy index of about 2.5 to 10; and
(h) water in an amount effective to avoid destruction of the desired thixotropic properties.

2. A composition according to claim 1 wherein said detergent active material comprises a mixture of mono- and di-$C_{8-14}$ alkyl diphenyl oxide sodium sulfonates.

3. A composition according to claim 1 wherein said foam depressant comprises alkyl acid phosphate esters containing one or two $C_{12-20}$ alkyl groups or mixtures thereof.

4. A composition according to claim 1 containing a total combined sodium tripolyphosphate, sodium silicate and sodium carbonate salt concentration of about 20 to 50 wt.%.

5. A composition according to claim 1 containing at least about 20 wt.% of sodium tripolyphosphate.

6. A composition according to claim 1 wherein said thickener comprises a smectite or attapulgite clay or mixture thereof.

7. A composition according to claim 1 containing about 2 to 9 wt % sodium carbonate.

8. A composition according to claim 1 containing about 1.5 to 10% thixotropic thickener.

9. A composition according to claim 1 containing about 0.3 to 0.8% detergent active material.

10. A composition according to claim 9 wherein the foam depressant is a mixture of monostearyl and distearyl acid phosphates in a weight ratio of about 1.2:1.

11. A composition according to claim 10 wherein the weight ratio of detergent active material (d) to foam depressent (c) is about 10:1 to 1:1.

12. A composition according to claim 10 wherein the weight ratio of detergent active material (d) to foam depressent (c) is about 4:1 to 1:1.

13. A composition according to claim 1 wherein the foam depressant (e) is of the formula:

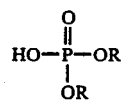

wherein one or more R group is independently selected from $C_{12-20}$ alkyl groups.

14. A composition according to claim 13 having a thixotropy index of about 6 to 8.

15. The composition according to claim 1 wherein the foam depressant (e) is of the formula:

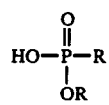

wherein one or more R group is independently selected from $C_{12-20}$ alkyl groups.

16. An aqueous thixotropic automatic dishwasher composition having a pH of about 10.5 to 13.5 and comprising approximately by weight:

(a) 20 to 30% sodium tripolyphosphate;
(b) 2.5 to 20% sodium silicate;
(c) 2 to 9% sodium carbonate;
(d) 0.3 to 0.8% chlorine bleach stable, water-dispersible organic detergent active material selected from the class consisting of branched alkali metal mono- and di-$C_{8-14}$ alkyl diphenyl oxide mono- and disulfonates and linear alkali metal mono- di-$C_{8-14}$ alkyl diphenyl oxide mono and disulfonates;
(e) 0.1 to 0.5% chlorine bleach stable foam depressant selected from the class consisting of alkyl phosphonic acid esters and alkyl acid phosphate esters;
(f) sodium hypochlorite in an amount effective to provide 0.8 to 1.6% of available chlorine;
(g) a thixotropic thickener in an amount sufficient to provide the composition with a thixotropy index of about 2.5 to 10; and
(h) water in an amount effective to avoid destruction of the desired thixotropic properties.

17. A composition according to claim 16 containing about 1.5 to 10% thixotropic thickener.

18. A composition according to claim 16 containing about 2 to 5% thixotropic thickener.

19. A composition according to claim 17 wherein said thixotropic thickener is clay.

20. A composition according to claim 16 containing from about 45 to about 75% water.

21. A composition according to claim 16 containing from about 55 to 65% water.

22. A composition according to claim 16 containing from about 5 to 15% sodium silicate.

23. An aqueous thixotropic automatic dishwasher composition having a pH of about 10.5 to 13.5 and comprising approximately by weight:

(a) 8 to 35% sodium tripolyphosphate;

(b) 5 to 15% sodium silicate having a $Na_2O:SiO_2$ ratio of about 1:2.2 to 1:2.8;

(c) 2 to 9% sodium carbonate;

(d) 0.1 to 5% chlorine bleach stable, water-dispersible organic detergent active material selected from the class consisting of branched alkali metal mono- and di-$C_{8-14}$ alkyl diphenyl oxide mono- and disulfonates and linear alkali metal mono- and di-$C_{8-14}$ alkyl diphenyl oxide mono- and disulfonates;

(e) 0.1 to 0.5% chlorine bleach stable foam depressant selected from the class consisting of mono- and di-$C_{16-18}$ alkyl phosphate esters;

(f) sodium hypochlorite in an amount effective to provide 0.8 to 1.6% of available chlorine;

(g) a thixotropic clay thickener in amount sufficient to provide the composition with a thixotropy index of about 2.5 to 10; and 55 to 65% water.

24. A method of preparing a composition according to claim 1 comprising first preparing an aqeuous dispersion of any (e) component being employed, mixing said dispersion with water containing components (a), (b) and any (c) employed, and then mixing the resulting mixture with components (d), (f) and a previously prepared aqueous dispersion of component (g).

25. A method of preparing a composition according to claim 1 comprising mixing into water, in sequence, components (g), ½ of component (a), any (e), (f), any (c), (b), the other ½ of component (a), and finally (d).

26. A method of washing in an automatic dishwasing machine having a detergent dispenser cup and adapted to provide a wash cycle, which comprises applying to a detergent composition having a gel consistency a sufficient shear to liquefy said composition, pouring said liquefied composition into the dispenser cup of said machine, permitting said composition to thicken upon standing and dissolving said composition in water to form a solution used in the washing cycle of said machine wherein said detergent composition comprises:

(a) 8 to 35% sodium tripolyphosphate;

(b) 2.5 to 20% sodium silicate;

(c) 0 to 9% sodium carbonate;

(d) 0.1 to 5% chlorine bleach stable, water-dispersible organic detergent active material selected from the class consisting of alkali metal mono- and di-$C_{8-14}$ alkyl diphenyl oxide mono- and disulfonates and linear alkali metal mono- and di-alkyl diphenyl oxide mono- and di-sulfonates;

(e) 0.1 to 5% chlorine bleach stable foam depressant selected from the class consisting of alkyl phosphonic acid esters and alkyl acid phosphate esters;

(f) sodium hypochlorite in an amount to provide about 0.2 to 4% of available chlorine;

(g) a clay thixotropic thickener sufficient to provide the composition with a thixotropy index of about 2.5 to 10; and (h) water in an amount effective to avoid destruction of the desired thixotropic properties.

27. The method according to claim 26 wherein the foam depressant (e) is of the formula:

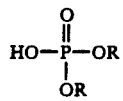

wherein one or more R group is independently selected from $C_{12-20}$ alkyl groups.

28. The method according to claim 26 wherein the foam depressant (e) is of the formula:

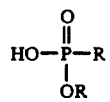

wherein one or more R group is independently selected from $C_{12-20}$ alkyl groups.

29. A method according to claim 26 the detergent composition containing about 2 to 9 wt % sodium carbonate.

30. A method according to claim 26 the detergent composition containing about 1.5 to 10% thixotropic clay thickener.

31. A method according to claim 26 the detergent composition containing from about 45 to about 75% water.

32. A method according to claim 26 the detergent composition containing from about 55 to 65% water.

33. A method according to claim 26 the detergent composition containing from about 5 to 15% sodium silicate.

34. A method according to claim 26 the foam depressant comprising a mixture of monostearyl and distearyl acid phosphates in a weight ratio of 1:2.1.

35. A method according to claim 26 wherein the weight ratio of detergent active material (d) to foam depressant (e) is about 10:1 to 1:1.

36. A method according to claim 26 wherein the weight ratio of detergent active material (d) to foam depressant (e) is about 4:1 to 1:1.

37. A method of washing dishes in an automatic dish washer comprising mixing with the aqueous wash bath therein an effective amount of a composition as defined in claim 1.

38. A method of washing dishes in an automatic dishwasher coomprising mixing with the aqueous wash bath therein an effective amount of a composition as defined in claim 33.

* * * * *